US006062310A

United States Patent [19]

Wesson et al.

[11] Patent Number: 6,062,310

[45] **Date of Patent: *May 16, 2000**

[54] FULL BORE GUN SYSTEM

[75] Inventors: David S. Wesson, Waxahachie; Don Shewchenko; James Rollins, both of Fort Worth; Lile Andrich, Mansfield, all of Tex.

[73] Assignee: Owen Oil Tools, Inc., Fort Worth, Tex.

[ * ] Notice: This patent is subject to a terminal disclaimer.

[21] Appl. No.: 09/112,713

[22] Filed: Jul. 9, 1998

Related U.S. Application Data

[63] Continuation-in-part of application No. 08/814,631, Mar. 10, 1997, Pat. No. 5,829,588.

[51] Int. Cl.[7] ..... E21B 43/117

[52] U.S. Cl. ..... 166/297; 166/55.1; 175/4.54; 175/4.6

[58] Field of Search ..... 175/4.6, 4.54; 166/55.1, 297; 102/321, 323

[56] References Cited

U.S. PATENT DOCUMENTS

| | | | |
|---|---|---|---|
| 2,749,840 | 6/1956 | Babcock | 175/4.6 |
| 2,968,243 | 1/1961 | Turechek | 175/4.6 |
| 3,211,093 | 10/1965 | McCullough et al. | 175/4.6 |
| 3,233,688 | 2/1966 | Bell | 175/4.6 |
| 3,706,344 | 12/1972 | Vann | 166/297 |
| 4,619,333 | 10/1986 | George | 175/4.52 |
| 4,739,707 | 4/1988 | Regalbuto et al. | 175/4.6 |
| 5,323,684 | 6/1994 | Umphries | 175/4.6 |
| 5,598,891 | 2/1997 | Snider et al. | 175/4.6 |
| 5,829,538 | 11/1998 | Wesson et al. | 175/4.6 |

*Primary Examiner*—Hoang Dang
*Attorney, Agent, or Firm*—Felsman, Bradley, Vaden, Gunter & Dillon; Charles D. Gunter, Jr.

[57] ABSTRACT

A tubing conveyed perforating apparatus is shown which includes a tubular assembly made up of a plurality of tubular sections. A plurality of explosive charges are located within the interior bore of at least two of the tubular sections of the tubular assembly. A firing head is carried on the tubular assembly for detonating the explosive charges to perforate a surrounding well bore. The firing head has a concentric detonator arrangement within a hollow central bore. The explosive charges are held within the interior bore of the tubular section by a support. The explosive charges and charge support are comprised of materials which disintegrate upon detonation of the explosive charges, whereby the interior bore of the tubular assembly is fully open after detonation.

21 Claims, 8 Drawing Sheets

FULL BORE GUN SYSTEM

1. CROSS REFERENCE TO RELATED APPLICATIONS

This application is a continuation-in-part of earlier filed Ser. No. 08/814,631 filed Mar. 10, 1997, by David S. Wesson and Don Shewchenko, entitled "Full Bore Gun System", presently pending issued Nov. 3, 1998 U.S. Pat. No. 5,829, 538.

BACKGROUND OF THE INVENTION

2. FIELD OF THE INVENTION

The present invention relates generally to a tubing conveyed perforating gun system of the type used to perforate a well bore for the production of well bore fluids and, specifically, to such a system with internal components which disintegrate upon detonation of the associated firing system so that the interior bore of the tubing string is fully open after detonation.

3. DESCRIPTION OF THE PRIOR ART

As oil and gas well bores are being drilled, the integrity of the borehole is preserved by cementing a casing or liner in place in the borehole. The casing or liner is a metal, cylindrical conduit which must be punctured or perforated over the desired production interval in order to produce well bore fluids once drilling is complete. A perforating gun which utilizes some form of fired projectile and an explosive charge is used to perforate the casing or liner to begin production from the well.

Prior perforating gun techniques have either utilized tools which were run on a wireline or cable or have utilized tubing conveyed devices which were run on a tubing string to a desired depth in a well bore. Tubing conveyed devices have certain advantages over wireline methods, for example, in allowing safe, immediate release of formation pressure at maximum pressure differentials into the tubing string. With tubing conveyed perforating systems, the tubing can be run into position, a packer set to seal off the well bore, and the surface well head equipment can be installed. The packer setting can be checked by circulating fluid under pressure through the well annulus or through the well tubing string. Once the surface work is completed and tested for safety, the perforating gun can be fired to bring in the well. Since all surface work is completed before the perforating gun is fired, operating safety is enhanced.

Once the perforating gun has been fired and the casing is perforated, there are basically three methods for dealing with the remaining perforating apparatus: (1) the perforating guns can be dropped to the bottom of the well bore with a mechanical gun release or automatic gun release; (2) the guns can be removed from the well; or (3) the guns can remain on the tubing. In the past, the first alternative was generally the best, since releasing the perforating gun portion of the apparatus from the remainder of the tubing string provided a greater flow area through the tubing string for production of well bore fluids and also allowed tools and other devices to be run through the interior bore of the tubing string without contacting the perforating gun apparatus. However, this choice generally required an extra "rat hole" to be drilled. Removing the perforating gun portion of the apparatus from the well also offered the advantages of a full open bore but required a separate trip out of the well adding to the overall expense and risking damage to the productivity of the well. The third alternative of leaving the guns in the well bore was the least desirable since the perforating apparatus cannot be left adjacent the producing area in the well if production logging or other work is desired.

The present invention has as its object to provide a tubing conveyed perforating apparatus which can be conveyed on production casing or tubing, positioned in a well bore adjacent a producing formation and fired and which automatically becomes full bore thereafter to allow logging tools to be conveyed through the gun portion of the apparatus.

Another object of the invention is to provide a tubing conveyed perforating apparatus which provides a tubing string with a full open interior bore after firing and without requiring a separate trip out of the well or the drilling of an additional "rat hole."

Another object of the invention is to provide a tubing conveyed perforating apparatus which features a tubular assembly including a plurality of tubular sections which are threadedly connected by external collars, whereby the interior bore of the tubular assembly adjacent the firing section is of generally constant internal diameter.

Another object of the invention is to provide such a perforating apparatus with a firing head which features a concentric detonator arrangement with a hollow central bore.

Another object of the invention is to provide a perforating apparatus in which the individual explosive charges are not held in a traditional charge holder but are supported within one or more of the tubular sections of the apparatus by any temporary structure or medium which essentially disintegrates upon detonation of the charges.

Another object of the invention is to provide a perforating apparatus which is initially sealed at an upper end by a firing head and which is initially sealed at a lower end by a self-releasing or disintegrating plug so that the charge carrying portion of the device is initially isolated in an atmospheric chamber.

Another object of the invention is to provide such an apparatus which is simple in design and economical to manufacture.

SUMMARY OF THE INVENTION

The tubing conveyed perforating apparatus of the invention includes a tubular assembly made up of a plurality of tubular sections. Each of the tubular sections has a generally cylindrical exterior and a concentric interior bore. The tubular assembly has an upper connecting end for connection in a tubular string extending to the well surface and a lower end. A plurality of explosive charges are located within the interior bore of at least selected tubular sections. A plurality of such tubular sections can be ballistically connected and arranged end to end to extend downwardly. Preferably the tubular sections of the tubular assembly which hold the explosive charges are threadedly connected by external collars, whereby the interior bore of the tubular assembly which contains the explosive charges is of generally constant internal diameter. A firing head is provided for detonating the explosive charges to perforate the surrounding well bore. The firing head has a detonator arrangement which is concentric about the central vertical axis of the interior bore of the tubular assembly, thereby defining a hollow opening which communicates with the interior bore of the tubular assembly above and below the detonator arrangement.

A support means supports the plurality of explosive charges within the interior bore of at least a selected tubular section. The support means and plurality of explosive charges are comprised of materials which disintegrate upon detonation of the explosive charges, whereby the interior bore of the tubular assembly is fully open after detonation.

The firing head is preferably located above the explosive charges within the interior bore of the tubular assembly and includes a component which initially seals off the interior bore thereof from above. A self-releasing or disintegrating plug mounted at the lower end of the tubular assembly for initially sealing the interior bore from below. The interior bore of the tubular assembly between the firing head and self-releasing plug is initially an air-filled, atmospheric chamber.

In the method of the invention, a tubing conveyed perforating apparatus and a packer means are suspended from a tubing string at a subterranean location within a well bore. The packer is set within the well bore at a position which isolates a lower borehole portion of the well bore from an upper borehole portion thereof and which locates the perforating apparatus adjacent the production interval. The perforating apparatus is actuated to perforate the well casing adjacent the production interval to thereby allow production fluids to flow through the perforated interval, through a surrounding annular area of the well and upwardly through the tubing string to the well surface. Internal components of the perforating apparatus are formed from a disintegratable material which disintegrates during detonation of the explosive charges, whereby the interior bore of the tubular assembly is fully open after detonation.

The disintegratable components of the tubular assembly are initially isolated within the interior bore thereof at an upper end by the sealing component of the firing head and at the lower end by the self-releasing or disintegrating plug. The act of detonating the explosive charges disintegrates the sealing component of the firing head and releases the self-releasing plug from the apparatus, whereby the interior bore is fully open after detonation and substantial disintegration of the perforating apparatus internal components.

After firing the perforating apparatus, the production interval is then logged by lowering logging tools downwardly from the well surface through the tubing string and through the now open interior bore of the now perforated tubular assembly to the producing zone.

Additional objects, features and advantages will be apparent in the written description which follows.

DETAILED DESCRIPTION OF THE INVENTION

Figure 4:
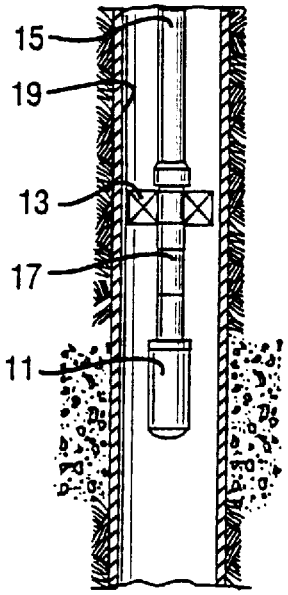
FIG. 4 Prior Art
FIGS. 4–7 are schematic views of a prior art perforation operation showing the release of the perforating gun portion of the device from the remainder of the tubular string after firing.

In order to best illustrate the advantages of the present invention, FIGS. 4–7 show a prior art perforating operation using a tubing conveyed perforating gun which is dropped to the bottom of the well bore after firing. Referring to FIG. 4, a typical prior art perforating system is shown which includes a perforating gun 11 which is run below a well packer 13 and which is connected to a tubing string 15 by a disconnect sub 17. The tubing string 15 extends to the well surface (not shown) of the cased well bore 19.

Figure 5:
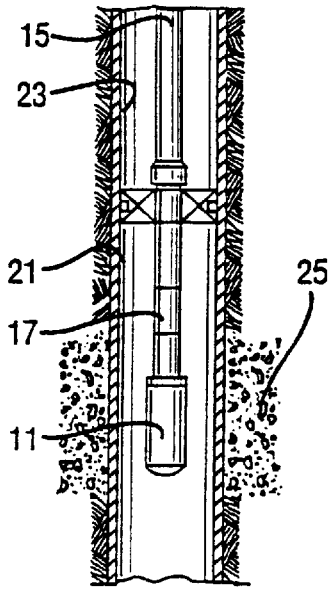
FIG. 5 Prior Art

As shown in FIG. 5, the packer is set at the desired location which isolates a lower borehole portion 21 from an upper borehole portion 23 and which locates the perforating apparatus adjacent a production interval 25.

Figure 6:
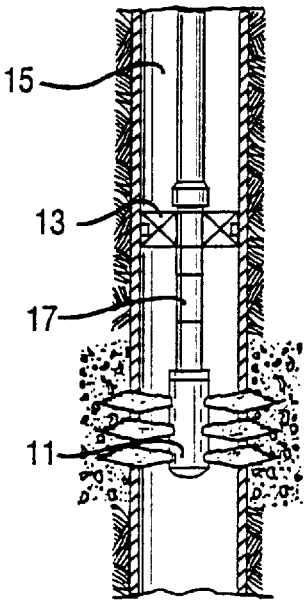
FIG. 6 Prior Art
Figure 7:
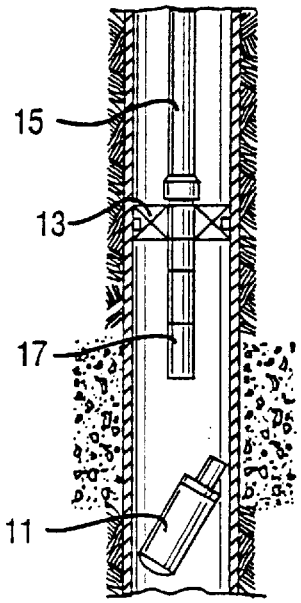
FIG. 7 Prior Art

As shown in FIG. 6, the perforating apparatus 11 is then actuated to perforate the well casing 19 adjacent the production interval 25. This can be accomplished, in the case of a percussion detonated device by passing a weight down the interior of the tubing string from the well surface to contact a percussion detonator. Such devices are well known in the art, for example, U.S. Pat. No. 2,876,843 to Huber, issued Mar. 10, 1959, shows such a tubing conveyed perforating apparatus in which a weight contacts a percussion detonator to fire the perforating guns. As shown in FIG. 7, the disconnect sub is then actuated to release the perforating apparatus, thereby allowing the apparatus to drop to the bottom of the well bore. As discussed previously, this type technique has several disadvantages including the presence of additional relatively large debris in the well which must be accommodated by drilling a rat hole.

Turning to FIGS. 1A–3A, there is shown the tubing conveyed perforating apparatus of the invention, designated generally as 27. The perforating apparatus 27 includes a tubular assembly made up of a plurality of tubular sections 31, 33, 35. Each tubular section has a generally cylindrical exterior and a generally concentric interior bore (37 in FIG. 1A) . The tubular assembly has an upper connecting end (not shown) for connection in the tubing string (15 in FIG. 4) leading to the well surface and has a lower end (39 in FIG. 3A).

Figure 1A:
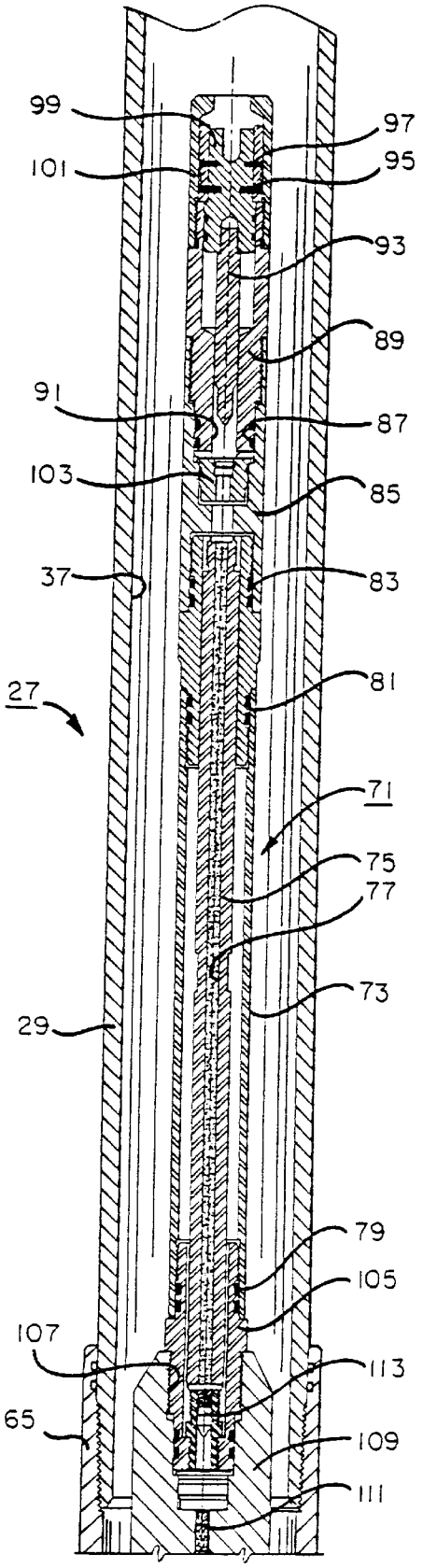
FIG. 1A is a side, cross-section view of the upper end of the tubing conveyed perforating apparatus of the invention in the running-in position.
Figure 1B:
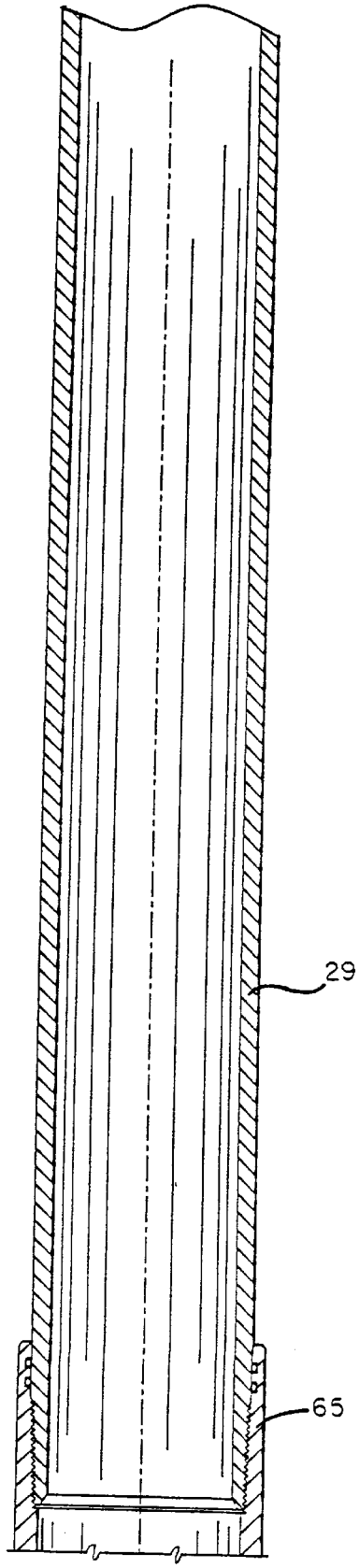
FIG. 1B is a side, cross-sectional view of the apparatus of FIG. 1A after firing and release of the firing head.
Figure 2A:
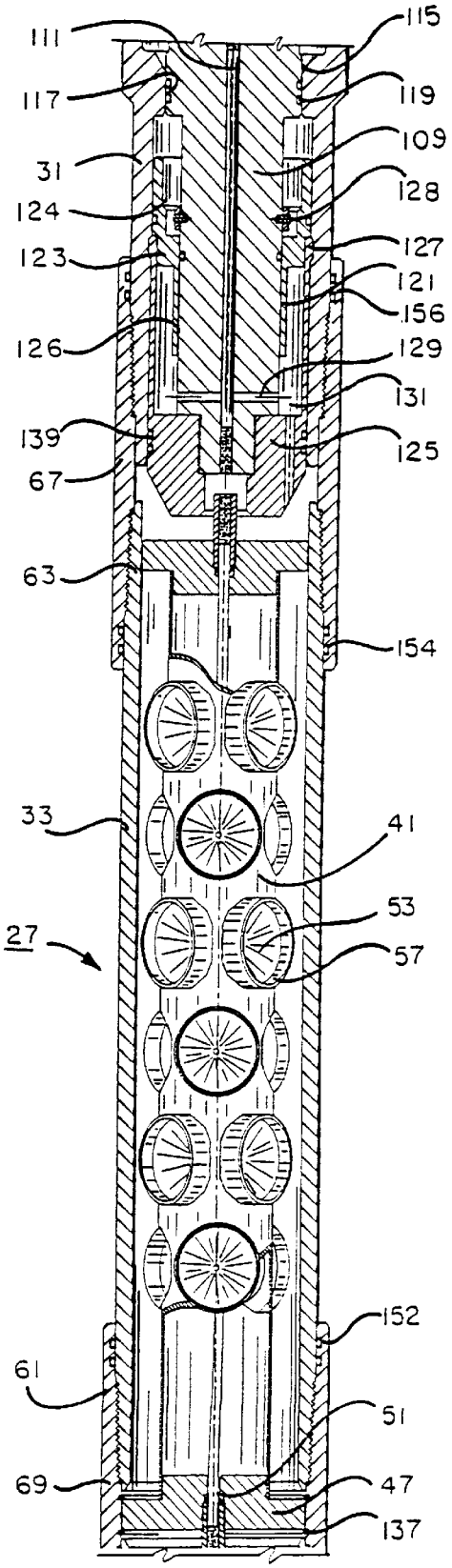
FIG. 2A is a downward continuation of FIG. 1A showing the lower end of the firing head and one of the types of charge holders of the apparatus.
Figure 3A:
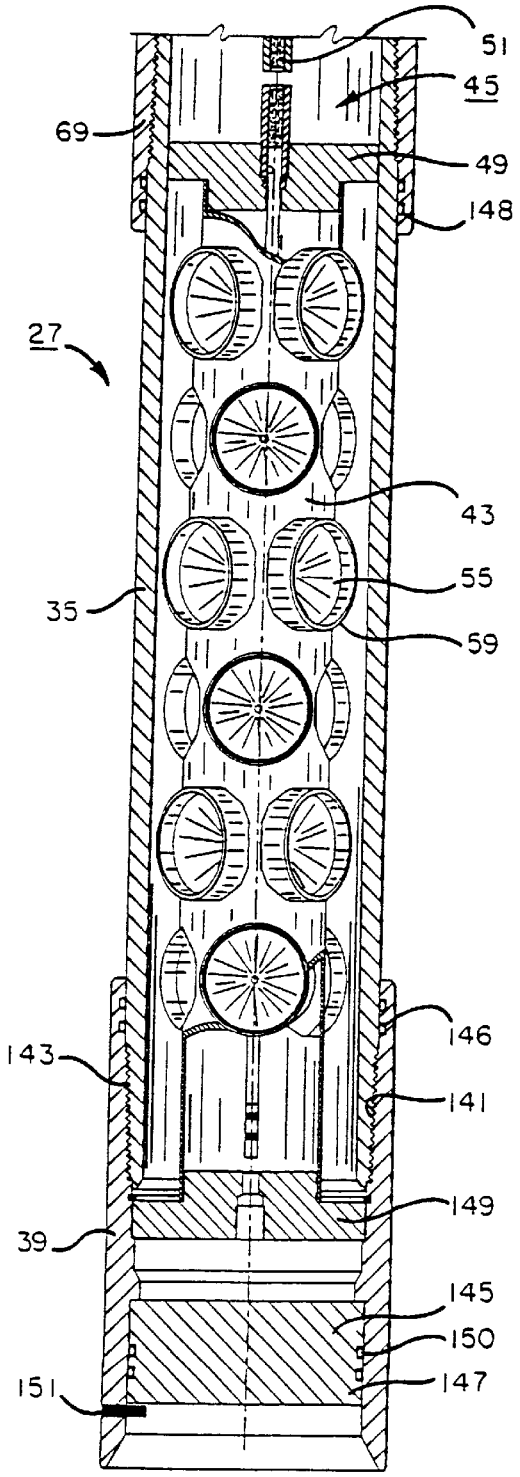
FIG. 3A is a downward continuation of FIG. 2A showing another type charge holder and the self-releasing plug of the apparatus.
Figure 3B:
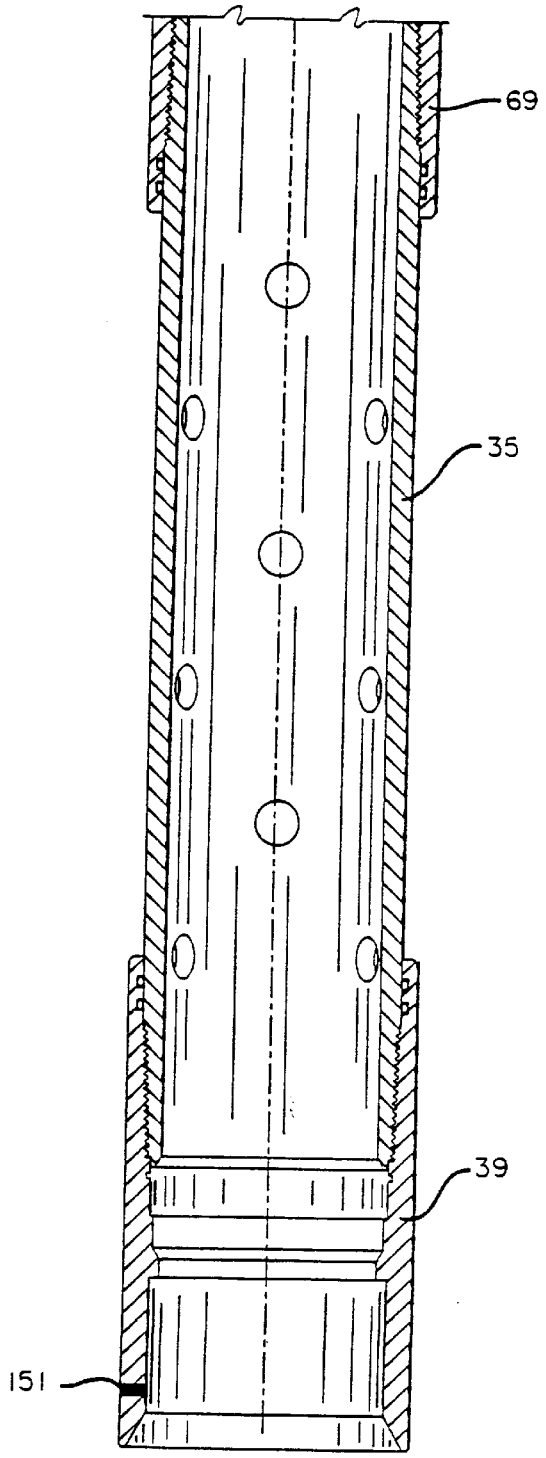
FIG. 3B is a downward continuation of FIG. 2B showing the full bore interior of the tubular assembly after firing.

A plurality of elongate charge holders (41, 43 illustrated in FIGS. 2A and 3A) are located within the interior bore 37 of the tubular assembly and are ballistically connected by means of bi-directional booster sections (e.g. section 45 in FIG. 3A) . In the embodiment of FIGS. 2A and 3A, the booster sections 45 include upper and lower end caps 47, 49. A det cord 51 passes through a central bore of the booster components for actuating the depending explosive charges.

A plurality of shaped explosive charges (53, 55 in FIGS. 2A and 3A) are mounted along the length of each of the charge holders 41, 43 and are arranged in a selected pattern and orientation for producing the desired perforating pattern upon detonation.

Preferably, the explosive charges 53, 55 are shaped charges which have special charge cases formed of a material which will vaporize upon detonation leaving only a very fine dust remnant. The preferred charge cases 57, 59 will be a commercially available zinc alloy ZA-5. The shaped charge cases can be made of any material or combination of materials which will disintegrate upon detonation such as metal alloys, powdered metals, aluminum, glass or ceramics or combinations thereof. The charge holders 41, 43 are preferably made from wood or other suitable rigid organic composite material that burns and essentially vaporizes upon detonation of the shaped charges. Any of the other internal alignment components, such as the booster transfer components 45 and end caps 47, 49 would be made of similar materials to that of the charge holder. Other acceptable materials in addition to wood or other rigid organic materials include powdered metals, composites, plastics, aluminum, zinc, paper, glass, ceramics or combinations thereof. It is only necessary that the disintegratable material not leave large size debris such as strips of metal behind upon detonation.

Each of the tubular sections 29, 33 and 35 are generally cylindrical members having opposite externally threaded extents (61, 63 in FIG. 2A) which are connected in the tubular assembly by means of external collars 65, 67, 69, whereby the interior bore 37 of the tubular assembly which contains the charge holders 41, 43 is of generally constant internal diameter. By making up the tubular assembly with external threads 61 and couplings 69 (FIG. 2A), the I.D. of the assembly forms a generally slick interior surface after firing, as illustrated in FIGS. 1B–3B. In the typical perforating gun system, a "tandem" connector is utilized to attach multiple guns together end to end. The collar type connection of the apparatus of the invention allows the perforating system to remain full bore after firing. In addition to utilizing external couplings, integral joint (flush joint inside and outside) connections could also be employed.

As shown in FIGS. 1A–2A, a conventional TCP firing head 71 is located above the elongate charge holders 41, 43 within the interior bore 37 of the tubular assembly. The firing head 71 includes an outer tubular body 73 which surrounds an inner tubular body 75, the inner tubular body having an internal bore 77 for containing a pyrotechnic material. Appropriately located O-ring seal sections 79, 81, 83 isolate the internal bore 77. A sub 85 has an internal bore 87 in which is located plug 89 having a bore 91 through which a firing pin 93 can travel upon release of the shear means such as pins 95, 97 which initially connect the firing piston 99 within an external coupling 101.

As will be appreciated by those skilled in the art, downward pressure exerted on the upper end 99 of the firing head drives the firing pin 93 downwardly to strike the percussion initiator 103, igniting the pyrotechnic powder in the bore 77.

The lower end 105 of the traditional firing head is threadedly received within an upper bore 107 of a novel support sub which includes a sub body 109 having an internal bore 111 containing a det cord which is ignited by the firing mechanism 113 of the head 71. As best seen in FIG. 2A, the sub body 109 has a region of relatively greater external diameter 115 which contacts a seal surface 117 including O-rings 119 of the specially machined tubular section 31 where it forms a sliding seal. The sub body 109 also has a region of lesser relative diameter 121 which is surrounded by a retaining sleeve 123 including an upper flange portion 124 and a lower flange portion 126. The retaining sleeve 123 initially prevents downward movement of the sub body 109 in the direction of the elongate charge holders 41. The retaining sleeve 123 is also surrounded by a collet 125 having upwardly extending collet fingers 127 which initially underlay the retaining sleeve 123 and contact a shoulder region thereof for supporting the retaining sleeve, and hence the sub body 109 in the position shown in FIG. 2A. A sleeve 128 is provided to initially resist the upward movement of the retaining sleeve 123.

Figure 2B:
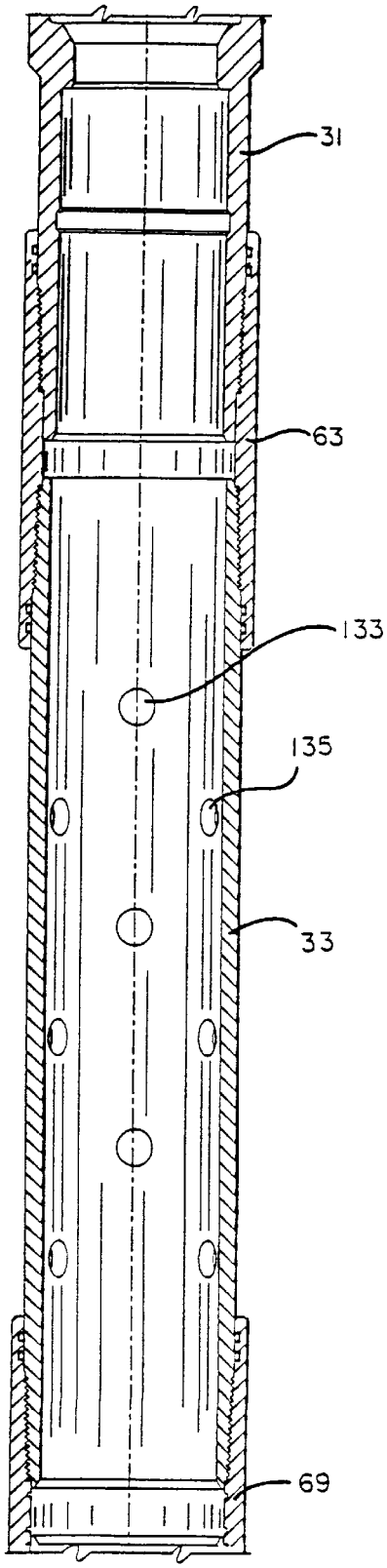
FIG. 2B is a downward continuation of FIG. 1B after firing the apparatus.

Upon actuation of the firing head 71 by any convenient means, the explosive gases pass from the central bore 111 through the radial bores 129 to the annular region 131, thereby driving the upper flange portion 124 of retaining sleeve 123 in an upward direction, whereby the collet fingers 127 collapse inwardly, releasing the sub body 109, and hence the entire firing head 71 so that the firing head is automatically released to fall through the interior bore of the tubular assembly and out the bottom thereof. FIG. 2B shows the interior of the special tubular section 31 and of the tubular section 33 after firing, the section 33 being perforated by holes 133, 135.

Referring again to FIG. 2A and 3A, it will be appreciated that prior to firing the explosive charges, the charge holders 41 and explosive charges 53 were contained within an air-filled, atmospheric chamber created between the O-ring seals 150 in the plug 145 and the O-ring seals 146, 148, 152, 154, 156 provided between each tubular section and external collar. Thus, prior to firing, the explosive charges are initially isolated in an atmospheric chamber from the surrounding well bore fluids.

As shown in FIG. 3A, the tubular section 35 containing the second downwardly extending charge holder 43 terminates in a lower end member 39. Member 39 is a generally cylindrical body having an internally threaded surface 141 which threadedly engages the externally threaded lower extent 143 of the tubular section 35. The self-releasing plug 145 is located within the mouth opening 147 thereof below the charge carrier end cap 149. In the embodiment shown, the self-releasing plug 145 is made of a frangible material such as a ceramic which will fragment into many pieces upon firing of the perforating system. In the embodiment illustrated, the plug is a generally cylindrical disk having circumferential grooves for carrying external O-ring seals 150 and is initially held in position by means of one or more shear pins 151. The plug 145 could also be made from aluminum or cast iron.

In operation, the tubing conveyed perforating apparatus of the invention is run into position on a tubing string, such as string 15 shown in FIG. 4. After setting the packer in the well bore, the firing head is actuated, whereby the explosive powders within the bores 77, 111 ignite the explosive charges 53, 55 on the charge holders, thereby perforating the tubular sections 33, 35 and the surrounding well bore casing. The force of detonation causes opposite relative movement of the retaining sleeve 123 and its upper flange portion 124 and the collet fingers 127, releasing the firing head. The force of the detonation also shears the pins 151 allowing the bottom plug 145 to be ejected downwardly from the tubing assembly and/or fragments the plug. By manufacturing the charge holders and explosive charge cases of materials which disintegrate upon firing, these materials essentially vaporize leaving a full bore tubing interior as shown in FIGS. 1B–3B. Production fluids can then flow into the well bore annulus below the packer, into the interior of the tubular assembly and upwardly to the well surface. Logging tools and other equipment can be run downwardly from the well surface through the interior of the tubing string to the production interval.

FIGS. 8A–E illustrate another form of the tubing conveyed perforating apparatus of the invention designated generally as 160. The apparatus 160 is similar in most respects to the embodiment of the invention previously described with the exception of the firing head mechanism and means for supporting the explosive charges, as will be more fully explained.

Figure 8A:
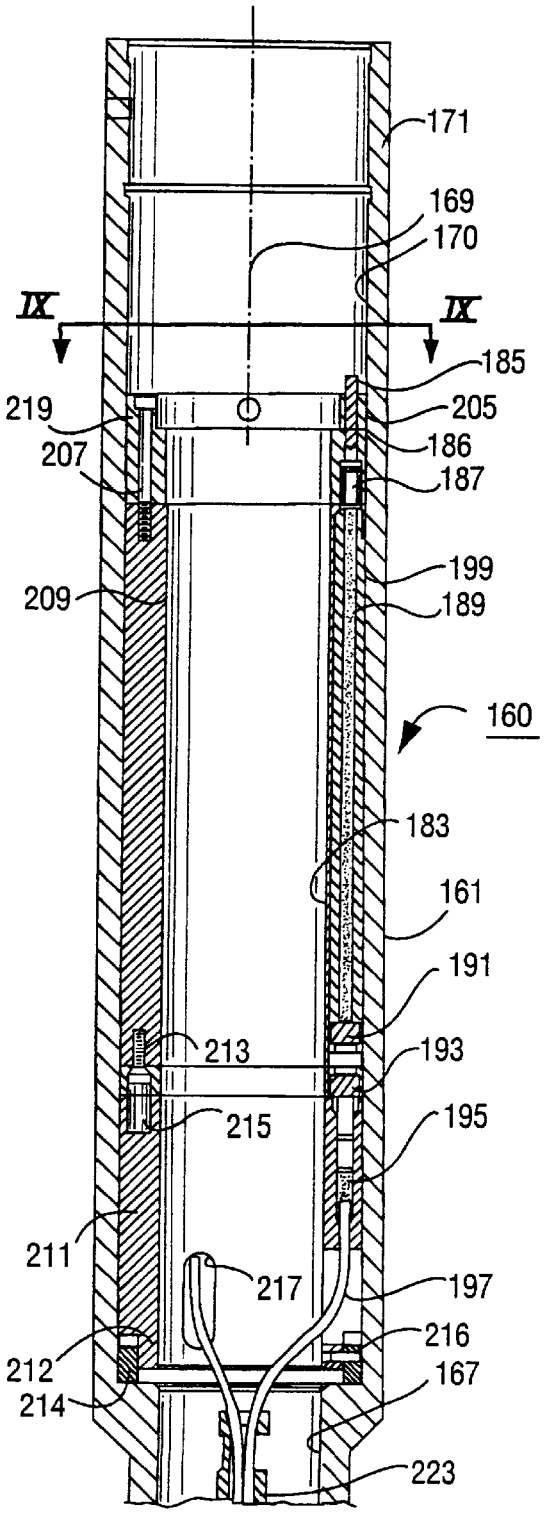
FIG. 8A is a side, cross-section view o the upper end of another embodiment of the tubing conveyed perforating apparatus of the invention in the running-in position.

In the apparatus of FIG. 8A, a tubular assembly is again comprised of a plurality of tubular sections 161, 163, 165. Each section has a generally cylindrical exterior and a generally concentric interior bore 167 (FIG. 8A) which is defined about a central vertical axis 169. The tubular assembly has an upper connecting end 171 which is internally threaded for connection in the tubing string leading to the well surface and has a lower end 173 (FIG. 8E). The tubular assembly can be provided with one or more internal profiles which can later be packed off, patched or straddled after the firing operation is complete.

A plurality of explosive charges 175 (FIG. 8B) are located within the interior bore 177 of at least one of the tubular sections 163. Again, the explosive charges 175 are preferably shaped charges which have special charge cases formed of a material which will vaporize upon detonation leaving only a very fine dust remnant. A preferred charge case is the previously described zinc alloy although any other material which will provide the required disintegration characteristics could be utilized as well.

Figures 8B, 10:
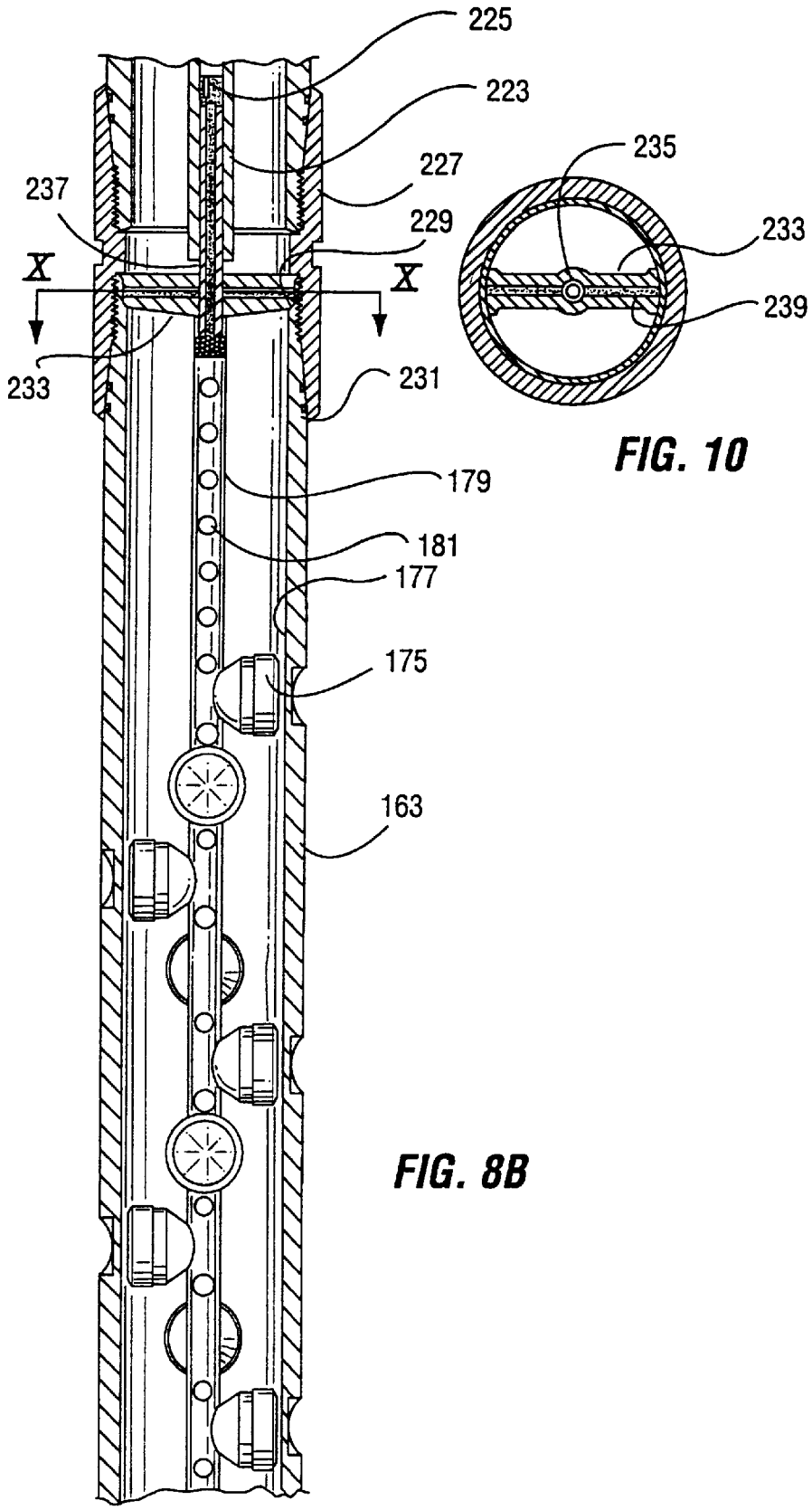
FIGS. 8B–8E are downward continuations of FIG. 8A.
FIG. 10 is a cross-sectional view taken along lines X—X in FIG. B.

The plurality of explosive charges are retained within the interior bore 177 of the tubular section 163 by a support means which may be a conventional charge carrier or which can be of a unique design. In the embodiment of FIG. 8B the support means 179 is a metallic strip formed of a metal alloy, such as the zinc alloy previously described. The strip has a plurality of vertical perforations 181 which contribute to its disintegratable nature. Any other convenient means could be utilized for temporarily supporting the shaped charges in spaced vertical fashion within the surrounding tubular member 163. For instance, the support means for supporting the plurality of explosive charges 175 could be a disintegratable medium which surrounds and supports the explosive charges in spaced vertical fashion within the tubular section 163. For example, a suitable synthetic medium such as a polyurethane foam or other "potting" type compound might be utilized. It is not necessary that a conventional "charge holder" be utilized since the components of the interior of the apparatus will be substantially disintegrated upon use.

The plurality of explosive charges 175 are detonated by means of a firing head which is illustrated in a preferred form in FIG. 8A. The firing head features a detonator arrangement which is concentric about the central vertical axis 169 of the interior bore 167 of the tubular assembly and thereby defines a hollow opening 183 which communicates with the interior bore 167 of the tubular assembly above and below the detonator arrangement. The firing head illustrated in FIG. 8A thus differs from the firing head illustrated in FIGS. 1A–2A in providing an initially open bore or opening 183.

FIG. 8A shows one of the concentrically arranged detonator elements which includes a firing pin 185 initially held in position by shear pins 186. Upon receiving a downward actuating force, the firing pin acts upon an ignitor 187. A time delay fuse 189 actuates a firing pin cartridge 191 which, in turn, actuates the main detonator 193. A bidirectional booster 195 ballistically connects the main detonator 193 with a detonator cord 197 which passes downwardly through the internal bore 167 for actuating the depending explosive charges.

As will be apparent to those skilled in the art, the detonator 193 could be provided as a stand alone unit for use with a retrievable or droppable firing head or initiator.

Figure 9:
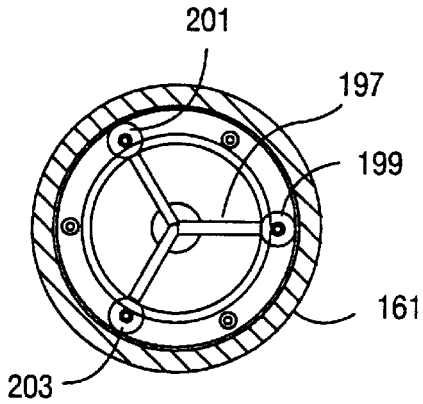
FIG. 9 is a cross-sectional view taken along lines IX—IX in FIG. 8A.

As shown in FIG. 9, there are preferably three equidistantly spaced detonators 199, 201, 203 which are spaced in concentric fashion about the central vertical axis 169 of the interior bore 167 of the tubular assembly. The detonators are supported by an ignitor ring 205 which carries a plurality of spaced cap screws which, in turn, support the ignitor retainer 209. The ignitor retainer 209 is a cylindrical body which contains the spaced time delay fuse 189. The main detonator 193 and bidirectional booster 195 are contained within a cylindrical detonator ring 211 which is held in position by means of a cap screw 213 and alignment pin 215. The detonator ring 211 has a series of apertures 217 which allow the det cords 197 to be fed downwardly along the vertical axis 169 of the apparatus.

As shown in FIGS. 8A and 8B, the det cords 197 pass through a transfer tube 223 which also contain a bidirectional booster 225 for ballistically connecting the det cord to the depending explosive charges. The detonator ring 211 has a stepped lower extent 212 which is surrounded by a shear ring 214. The shear ring is connected thereto by means of shear pin 216.

The firing head also includes a sealing component or element. In the embodiment of the device shown in FIG. 8A, the sealing element can comprise a ceramic disk (not shown) which is received within the cylindrical bore 170 above the firing pin 185. Downward movement of the firing actuator, as described with respect to FIGS. 1A-2A, would fracture the ceramic disk as the firing operation was initiated. The ceramic disc thus initially seals the upper end of the firing head section but is broken away during an initial step in the actuation of the firing means as the firing pin 185 is struck by a downwardly moving actuator force.

As shown in FIGS. 8A and 8B, the det cord 197 passes through a transfer tube 223 which houses a second bidirectional booster 225.

An external collar 227 is internally threaded at the upper and lower extents thereof for engaging the tubular sections 161 and 163 (FIG. 8B). An internal shoulder 229 formed within the upper extent 231 of the tubular section 163 supports an end element 233. As shown in FIG. 10, the end element 233 is a spoke-like member having a central opening 235 for receiving the det cord 237. The end element 233 also has an internal passageway 239 (FIG. 10) for receiving a det cord or explosive therein. The end element 233 is preferably comprised at least partly of a metal alloy, such as a zinc alloy, which will disintegrate upon ignition of the explosive charges. The end element 233 supports the strip 179 within the tubular section 163 and provides the ballistic connection for the det cord 237 passing to the explosive charges 175.

Figure 8C:
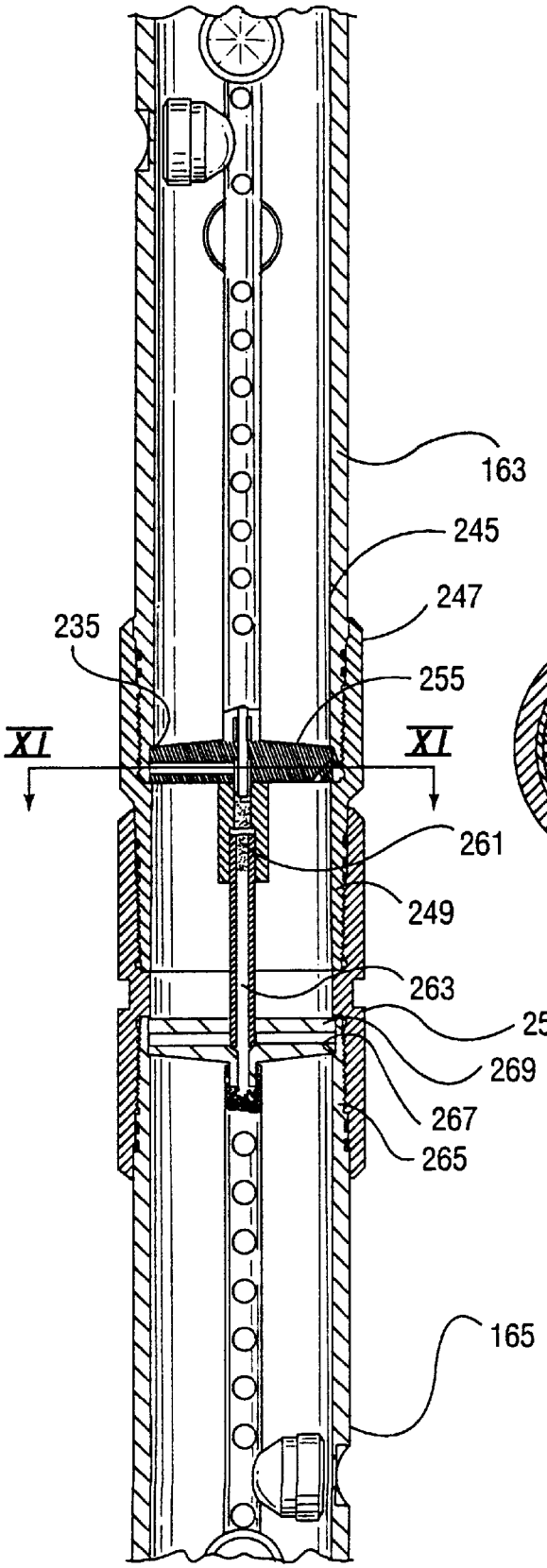
Figure 11:
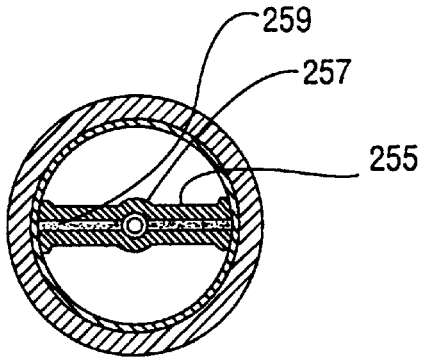
FIG. 11 is a cross-sectional view taken along lines XI—XI in FIG. 8C.

As shown in FIG. 8C, the lower extent 245 of the tubular section 163 is externally threaded and matingly engages a sub 247 which has an externally threaded lower extent 249 for engaging the mating internally threaded surface of a connecting collar 251. The lower extent 245 of the tubular section 163 has an internal profile 253 which supports a lower end element 255. As shown in FIG. 11, the lower end element 255 is similar to the top element 241 being a spoke-like member having a central bore 257 for receiving the det cord and outwardly extending passageways 259. In this case, however, the lower end element 255 may be formed of a synthetic plastic or composite material. A bidirectional booster 261 ballistically connects the assembly to the det cord 263.

Figure 8D:
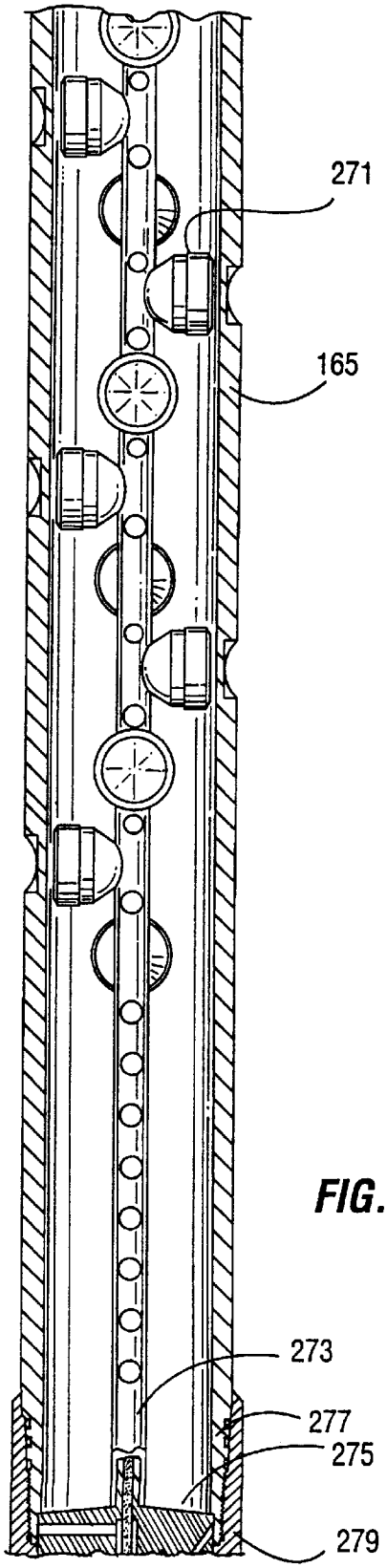
Figure 8E:
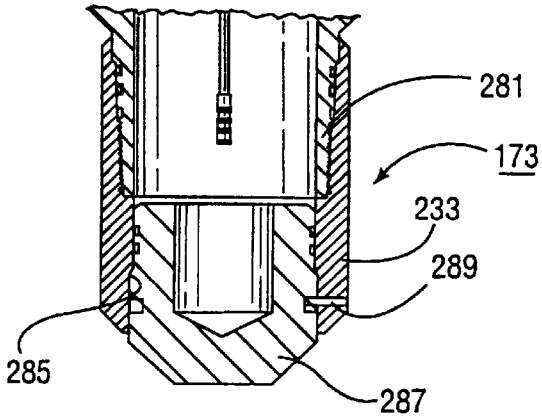

FIGS. 8C and 8D illustrate an additional tubular section 165, identical to section 163, carrying additional explosive charges 271. The upper extent 265 of the tubular section 165 has a similar internal profile 267 for supporting an additional end element 269. End element 269 is identical in design to end element 233. While only sections 163 and 165 are illustrated in the drawings, it will be understood that additional tubular sections could be physically connected end-to-end and ballistically connected as previously described. In FIG. 8D, the support strip 273 is connected to a lower end element 275. The end element 275 is identical to the element 255, previously described. The lower extent 277 of the tubular section 165 is externally threaded for engaging a mating sub 279. The sub 279 has a lower, externally threaded extent 281 which engages a mating external ring 283. The ring 283 has an internal bore 285 for receiving the bottom plug 287. The plug 287, in this case, is held in position by means of shear pins 289. The bottom plug is either released by means of shearing the pins 289 upon actuation of the explosive charges or is comprised of a frangible material so as to disintegrate upon firing of the apparatus, as previously described.

An invention has been provided with several advantages. The perforating apparatus of the invention provides a full bore tubing string after firing so that logging tools and other instruments or devices can be run without danger of becoming stuck or damaged. The perforating apparatus of the invention provides an open bore subsequent to detonation without requiring that the perforating guns be dropped to the bottom of the well bore or without requiring a separate trip into the well to remove the guns. The design is simple and economical to manufacture.

While the invention has been shown in only one of its forms, it is not thus limited but is susceptible to various changes and modifications without departing from the spirit thereof. For example, the firing head could be located on the bottom of the tool instead of the top. In addition to the external collars used to join the tubing sections, the tubing connections could be integral joints, as well. Instead of utilizing a self-releasing plug at the lower end of the tool, a seal assembly could be run on the lower end of the tool for landing within a permanent packer present in the well bore. Other modifications within the scope of the present invention will be apparent to those skilled in the art as well.

What is claimed is:

1. A tubing conveyed perforating apparatus used in perforating a surrounding well bore, the apparatus comprising:

a tubular assembly made up of at least one tubular section, the tubular section having a generally cylindrical exterior and an interior bore defined about a central vertical axis, the tubular assembly having an upper connecting end for connection in a tubing string extending to the well surface and a lower end;

a plurality of explosive charges located within the interior bore of the tubular section;

a support means for supporting the plurality of explosive charges within the interior bore of the tubular section;

a detonator arrangement which is concentric about the central vertical axis of the interior bore of the tubular assembly, the detonator arrangement defining a hollow opening which communicates with the interior bore of the tubular assembly above and below the detonator arrangement;

wherein the support means and plurality of explosive charges are comprised of materials which substantially disintegrate upon detonation of the explosive charges, whereby the interior bore of the tubular assembly is fully open after detonation.

2. The tubing conveyed perforating apparatus of claim 1, wherein the support means for supporting the plurality of explosive charges within the interior bore of the tubular section is a disintegratable strip which supports the explosive charges in spaced vertical fashion within the tubular section.

3. The tubing conveyed perforating apparatus of claim 1, wherein the support means for supporting the plurality of explosive charges is a disintegratable medium which surrounds and supports the explosive charges in spaced vertical fashion within the tubular section.

4. The tubing conveyed perforating apparatus of claim 1, wherein the detonator arrangement comprises a firing head carried within the tubular assembly and a plurality of detonators which are spaced in concentric fashion about the central vertical axis of the interior bore of the tubular assembly, the detonators being actuable by the firing head for detonating the explosive charges to perforate the surrounding well bore.

5. The tubing conveyed perforating apparatus of claim 4, wherein each spaced detonator has a detonator cord which depends therefrom, each detonator cord being fed downwardly within the tubular assembly along the central vertical axis for connection to the plurality of explosive charges.

6. The tubing conveyed perforating apparatus of claim 1, wherein the detonator arrangement of the firing head includes a ring-like component which holds a plurality of spaced detonators, the ring-like component having a hollow, central bore which communicates with the interior bore of the tubular assembly.

7. The tubing conveyed perforating apparatus of claim 1, wherein the tubular assembly includes at least two tubular sections which contain the explosive charges and which are threadedly connected by external collars, whereby the interior bore of the tubular assembly which contains the explosive charges is of generally constant internal diameter, the tubular assembly having at least one internal profile for use in subsequent well working operations.

8. A tubing conveyed perforating apparatus used in perforating a surrounding well bore, the apparatus comprising:

a tubular assembly made up of a plurality of tubular sections, each tubular section having a generally cylindrical exterior and an interior bore defined about a central vertical axis, the tubular assembly having an upper connecting end for connection in a tubing string extending to the well surface and a lower end;

a plurality of shaped explosive charges located within the interior bore of at least two of the tubular sections, the explosive charges being supported within each tubular section in spaced vertical fashion;

a support means for supporting the plurality of explosive charges within the interior bore of the at least two tubular sections;

a firing head located above the plurality of shaped charges within the interior bore of the tubular assembly and initially sealing off the interior bore thereof from above, the firing head having actuable firing means for detonating the explosive charges to perforate the surrounding well bore, the firing means including a detonator arrangement which is concentric about the central vertical axis of the interior bore of the tubular assembly, thereby defining a hollow opening which communicates with the interior bore of the tubular assembly above and below the detonator arrangement;

a self-releasing plug mounted at the lower end of the tubular assembly initially sealing the interior bore thereof;

wherein the support means and plurality of explosive charges are comprised of materials which disintegrate upon detonation of the explosive charges, whereby the interior bore of the tubular assembly is fully open after detonation.

9. The tubing conveyed perforating apparatus of claim 8, wherein the firing head initially seals off the interior bore of the tubular assembly by means of a frangible disk section included as a part of the firing head, the frangible disk being broken away during an initial step in the actuation of the firing means.

10. The tubing conveyed perforating apparatus of claim 8, wherein the support means for supporting the plurality of explosive charges within the interior bore of the at least two tubular sections includes at least one end element which is supported on an internal shoulder provided in the interior bore of the at least a one selected tubular section, the end element having a spoke-like configuration.

11. The tubing conveyed perforating apparatus of claim 10, wherein at least a selected spoke of the end element has an inner passageway for receiving an explosive.

12. The tubing conveyed perforating apparatus of claim 11, wherein the end element is comprised at least partly of a zinc alloy.

13. The tubing conveyed perforating apparatus of claim 8, wherein the interior bore of the tubular assembly between the firing head and the self-releasing plug is initially sealed off from the surrounding well bore to form an air-filled, atmospheric chamber.

14. The tubing conveyed perforating apparatus of claim 8, wherein the support means and plurality of explosive charges are comprised of a material selected from the group consisting of wood and other rigid organic materials, plastics, aluminum, zinc, paper, glass, ceramics, powdered metal and other disintegratable composites and mixtures thereof.

15. The tubing conveyed perforating apparatus of claim 8, wherein the explosive charges are contained within surrounding charge cases, and wherein the charge cases are formed from disintegratable materials including zinc alloy, powdered metals, aluminum, glass, ceramics and combinations thereof.

16. The tubing conveyed perforating apparatus of claim 8, wherein the at least two tubular sections which contain the explosive charges are threadedly connected by external collars, whereby the interior bore of the tubular assembly which contains the explosive charges is of generally constant internal diameter.

17. A method of perforating a well bore having an upper borehole portion and a lower borehole portion including a production interval which is isolated from the well bore by a well casing or the like, the method comprising the steps of:

suspending a tubing conveyed perforating apparatus and a packer means from a tubing string at a subterranean location within the well bore;

setting the packer means within the well bore at a position which isolates the lower borehole portion of the well bore from the upper borehole portion thereof and which locates the perforating apparatus adjacent the production interval;

actuating the perforating apparatus to perforate the well casing adjacent the production interval to thereby allow production fluids to flow through the perforated interval, through a surrounding annular area of the well and upwardly through the tubing string to the well surface;

wherein the tubing conveyed perforating apparatus includes a tubular assembly made up of at least one tubular section, the tubular section having a generally cylindrical exterior and an interior bore defined about a central vertical axis the tubular assembly having an upper connecting end for connection in a tubing string extending to the well surface and a lower end;

a plurality of explosive charges located within the interior bore of the tubular section;

a support means for supporting the plurality of explosive charges within the interior bore of the tubular section;

a firing head for detonating the explosive charges to perforate the surrounding well bore, the firing head having a detonator arrangement which is concentric about the central vertical axis of the interior bore of the tubular assembly, thereby defining a hollow opening which communicates with the interior bore of the tubular assembly above and below the detonator arrangement;

wherein the support means and plurality of explosive charges are comprised of materials which substantially disintegrate upon detonation of the explosive charges, whereby the interior bore of the tubular assembly is fully open after detonation.

18. The method of claim 17, wherein the tubular assembly is made up with a firing head with a frangible element which initially seals the interior bore at an upper end thereof and a self-releasing plug which initially seals a lower end thereof, and wherein the act of detonating the explosive charges disintegrates the frangible element of the firing head and releases the self-releasing plug from the interior bore of the tubular assembly, whereby the interior bore of the tubular assembly is fully open after detonating and disintegration of the support means and explosive charges.

19. The method of claim 18, further comprising the steps of:

logging the producing interval, after perforating the well casing, by lowering logging tools downwardly from the well surface, through the tubing string and through the now open interior bore of the tubular assembly.

20. The method of claim 18, wherein the self-releasing plug is formed from a material which is frangible upon detonation, wherein the plug fragments into pieces upon firing of the perforating apparatus.

21. The method of claim 20, wherein the interior bore of the perforating apparatus between the firing head and the self-releasing plug is air-filled.

* * * * *

UNITED STATES PATENT AND TRADEMARK OFFICE

CERTIFICATE OF CORRECTION

PATENT NO. : 6,062,310 
DATED : May 16, 2000
INVENTOR(S) : David S. Wesson, Don Shewchenko, James Rollins and Lile Andrich It is certified that error appears in the above-identified patent and that said Letters Patent is hereby corrected as shown below:

Title page,
Item [63], Related U.S. Application Data, Patent No. "5,829,588" should be -- 5,829,538 --.

Signed and Sealed this

Thirty-first Day of December, 2002

JAMES E. ROGAN
*Director of the United States Patent and Trademark Office*